US009978311B2

(12) United States Patent
Hwang et al.

(10) Patent No.: US 9,978,311 B2
(45) Date of Patent: May 22, 2018

(54) PIXEL CIRCUIT AND DISPLAY APPARATUS INCLUDING THE PIXEL CIRCUIT

(71) Applicant: SAMSUNG DISPLAY CO., LTD., Yongin-si, Gyeonggi-do (KR)

(72) Inventors: Youngin Hwang, Yongin-si (KR); Jihye Kong, Yongin-si (KR); Yongsung Park, Yongin-si (KR); Inho Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 229 days.

(21) Appl. No.: 14/850,601

(22) Filed: Sep. 10, 2015

(65) Prior Publication Data

US 2016/0275869 A1 Sep. 22, 2016

(30) Foreign Application Priority Data

Mar. 20, 2015 (KR) ..... 10-2015-0039030

(51) Int. Cl.
*G09G 3/32* (2016.01)
*G09G 3/3258* (2016.01)

(52) U.S. Cl.
CPC ..... *G09G 3/3258* (2013.01); *G09G 2230/00* (2013.01); *G09G 2300/0819* (2013.01);
(Continued)

(58) Field of Classification Search
CPC ..... G09G 3/3258; G09G 2320/045; G09G 2230/00; G09G 2300/0819;
(Continued)

(56) References Cited

U.S. PATENT DOCUMENTS

2005/0017934 A1 1/2005 Chung et al.
2011/0157125 A1* 6/2011 Choi ..... H05B 33/0896 345/211

(Continued)

FOREIGN PATENT DOCUMENTS

KR 10-2005-0005646 A 1/2005
KR 10-2012-0062250 A 6/2012

(Continued)

*Primary Examiner* — Michael J Jansen, II
*Assistant Examiner* — Ivelisse Martinez Quiles
(74) *Attorney, Agent, or Firm* — Lewis Roca Rothgerber Christie LLP

(57) ABSTRACT

A pixel circuit and a display apparatus. The pixel circuit includes a first transistor configured to output a driving current corresponding to a data voltage to an output node, an OLED connected to the output node and configured to emit light according to the driving current output from the first transistor, a storage capacitor coupled to the first transistor and configured to store the data voltage, a second transistor configured to receive a reference voltage from the first transistor during a first time section, configured to diode-connect the first transistor, and configured to compensate for a threshold voltage of the first transistor, and a third transistor configured to diode-connect the first transistor during a second time section, configured to receive the data voltage through the first transistor for which the threshold voltage of the first transistor is compensated, and configured to transfer the data voltage to the storage capacitor.

14 Claims, 6 Drawing Sheets

(52) U.S. Cl.
CPC ..... *G09G 2310/0251* (2013.01); *G09G 2310/0262* (2013.01); *G09G 2320/045* (2013.01)

(58) Field of Classification Search
CPC ... G09G 2310/0251; G09G 2310/0262; G09G 3/3233
See application file for complete search history.

(56) References Cited

U.S. PATENT DOCUMENTS

| | | | | |
|---|---|---|---|---|
| 2011/0193850 | A1* | 8/2011 | Chung | G09G 3/3233 345/212 |
| 2012/0139890 | A1 | 6/2012 | Choi | |
| 2013/0002632 | A1* | 1/2013 | Choi | G09G 3/325 345/211 |
| 2013/0057532 | A1* | 3/2013 | Lee | G09G 3/3225 345/211 |
| 2014/0071112 | A1 | 3/2014 | Han | |
| 2014/0111563 | A1 | 4/2014 | Hwang et al. | |
| 2014/0139502 | A1* | 5/2014 | Han | G09G 3/3233 345/212 |
| 2015/0009199 | A1* | 1/2015 | In | G09G 3/3266 345/212 |
| 2015/0279269 | A1* | 10/2015 | Ishii | G09G 3/3233 345/690 |
| 2015/0379934 | A1* | 12/2015 | Xiaoling | G09G 3/3233 345/214 |

FOREIGN PATENT DOCUMENTS

| | | | |
|---|---|---|---|
| KR | 10-2012-0116547 | A | 10/2012 |
| KR | 10-2014-0033953 | A | 3/2014 |
| KR | 10-2014-0050361 | A | 4/2014 |

* cited by examiner

PIXEL CIRCUIT AND DISPLAY APPARATUS INCLUDING THE PIXEL CIRCUIT

CROSS-REFERENCE RELATED APPLICATION

This application claims priority to and the benefit of Korean Patent Application No. 10-2015-0039030, filed on Mar. 20, 2015, in the Korean Intellectual Property Office, the disclosure of which is incorporated herein in its entirety by reference.

BACKGROUND

1. Field

One or more exemplary embodiments relate to a pixel circuit and a display apparatus including the pixel circuit, and more particularly to a pixel circuit and a display apparatus including the pixel circuit whereby a brightness difference between pixels is minimized by sufficiently achieving a threshold voltage compensation time of a driving transistor.

2. Description of the Related Art

An organic light emitting apparatus includes sub pixels for displaying different colors. Each of the sub pixels includes a light emissive device for emitting light. The light emissive device operates according to a driving current corresponding to a value of a data voltage applied to a driving transistor. An amount of time taken to apply data corresponding to the level of the data voltage to the driving transistor may differ.

With regard to a pixel including a P-channel transistor (PMOS), a data voltage for expressing a low gray level is set to have a greater value than a data voltage for expressing a high gray level. When the data voltage having the greater value is applied to the driving transistor, the data voltage might not be accurately applied, due to a limited data write time.

If a display apparatus is manufactured to have a large screen size and to have high resolution, a brightness difference between pixels may occur due to an RC delay, which may be seriously affect a high data voltage applied for expressing a low gray level.

SUMMARY

One or more exemplary embodiments include a pixel circuit and a display apparatus including the pixel circuit, whereby a Mura phenomenon caused by a brightness difference in a low gray level may be reduced or prevented.

Additional aspects will be set forth in part in the description which follows and, in part, will be apparent from the description, or may be learned by practice of the presented embodiments.

According to one or more exemplary embodiments, a pixel circuit includes a first transistor configured to output a driving current corresponding to a data voltage to an output node, an organic light emitting diode connected to the output node and configured to emit light according to the driving current output from the first transistor, a storage capacitor coupled to the first transistor and configured to store the data voltage, a second transistor configured to receive a reference voltage from the first transistor during a first time section, configured to diode-connect the first transistor, and configured to compensate for a threshold voltage of the first transistor, and a third transistor configured to diode-connect the first transistor during a second time section, configured to receive the data voltage through the first transistor for which the threshold voltage of the first transistor is compensated, and configured to transfer the data voltage to the storage capacitor.

A first electrode of the storage capacitor may be coupled to a power voltage line, and a second electrode of the storage capacitor may be coupled to a gate electrode of the first transistor.

A first electrode of the second transistor and a first electrode of the third transistor may be coupled to a drain electrode of the first transistor, and a second electrode of the second transistor and a second electrode of the third transistor may be coupled to a gate electrode of the first transistor.

The pixel circuit may further include a fourth transistor having a first electrode coupled to a data line that is configured to supply the data voltage, the fourth transistor being configured to turn on during the first time section, and further being configured to transfer the data voltage to the third transistor, and a fifth transistor having a first electrode coupled to a reference voltage line supplying configured to supply the reference voltage, the fifth transistor being configured to turn on during the second time section, and further being configured to transfer the reference voltage to the second transistor.

The pixel circuit may further include a sixth transistor having a first electrode coupled to a power voltage line, and a second electrode coupled to a source electrode of the first transistor, and a seventh transistor having a first electrode coupled to the output node, and a second electrode coupled to an anode of the organic light emitting diode, wherein the sixth and seventh transistors are configured to turn on during a light emitting section.

The pixel circuit may further include an eighth transistor having a first electrode coupled to a gate electrode of the first transistor, and a second electrode coupled to an initialization voltage line, wherein the eighth transistor is configured to turn on during an initialization section, and is configured to apply an initialization voltage to the first transistor.

A level of the reference voltage may be greater than a level of the initialization voltage, and may be less than a level of the data voltage.

The pixel circuit may further include a ninth transistor having a first electrode coupled to an initialization voltage line, and a second electrode coupled to an anode of the organic light emitting diode, wherein the ninth transistor is configured to turn on during an initialization section, and is configured to apply the initialization voltage to the anode.

According to one or more exemplary embodiments, a display apparatus includes a plurality of data lines extending in a first direction, and configured to supply a data signal, a plurality of scan lines extending in a second direction, and configured to supply a scan signal, and a plurality of pixels respectively at intersections between crossing regions of the plurality of data lines and the plurality of scan lines, the pixels operating according to an initialization section, a threshold voltage compensation section, a data write section, and a light emitting section arranged in a sequential order, wherein each of the plurality of pixels includes an initialization section, a threshold voltage compensation section, a data write section, and a light emitting section arranged in a sequential order, a first transistor configured to output a driving current corresponding to a level of a data voltage to an output node, an organic light emitting diode coupled to the output node, and configured to emit light according to the driving current output from the first transistor, a storage capacitor coupled to the first transistor, and configured to store the data voltage, a second transistor configured to receive a reference voltage from the first transistor during the threshold voltage compensation section, configured to diode-connect the first transistor, and further configured to compensate for a threshold voltage of the first transistor and a third transistor configured to diode-connect the first transistor during the data write section, configured to receive the data voltage through the first transistor for which the threshold voltage of the first transistor is compensated, and further configured to transfer the data voltage to the storage capacitor.

A first electrode of the storage capacitor may be coupled to a power voltage line, and a second electrode of the storage capacitor may be coupled to a gate electrode of the first transistor.

A first electrode of the second transistor and a first electrode of the third transistor may be coupled to a drain electrode of the first transistor, and a second electrode of the second transistor and a second electrode of the third transistor may be coupled to a gate electrode of the first transistor.

The display apparatus may further include a fourth transistor having a first electrode coupled to a data line that is configured to supply the data voltage, the fourth transistor being configured to turn on during the first time section, and further being configured to transfer the data voltage to the third transistor, and a fifth transistor having a first electrode coupled to a reference voltage line configured to supply the reference voltage, the fifth transistor being configured to turn on during the second time section, and further being configured to transfer the reference voltage to the second transistor.

The display apparatus may further include a sixth transistor having a first electrode coupled to a power voltage line, and a second electrode coupled to a source electrode of the first transistor, and a seventh transistor having a first electrode coupled to the output node, and a second electrode coupled to an anode of the organic light emitting diode, wherein the sixth and seventh transistors are configured to turn on during a light emitting section.

The display apparatus may further include an eighth transistor having a first electrode coupled to a gate electrode of the first transistor, and a second electrode coupled to an initialization voltage line, wherein the eighth transistor is configured to turn on during an initialization section, and is configured to apply an initialization voltage to the first transistor.

A level of the reference voltage may be greater than a level of the initialization voltage, and may be less than a level of the data voltage.

The display control apparatus may further include a ninth transistor having a first electrode coupled to an initialization voltage line, and a second electrode coupled to an anode of the organic light emitting diode, wherein the ninth transistor is configured to turn on during an initialization section, and is configured to apply the initialization voltage to the anode.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
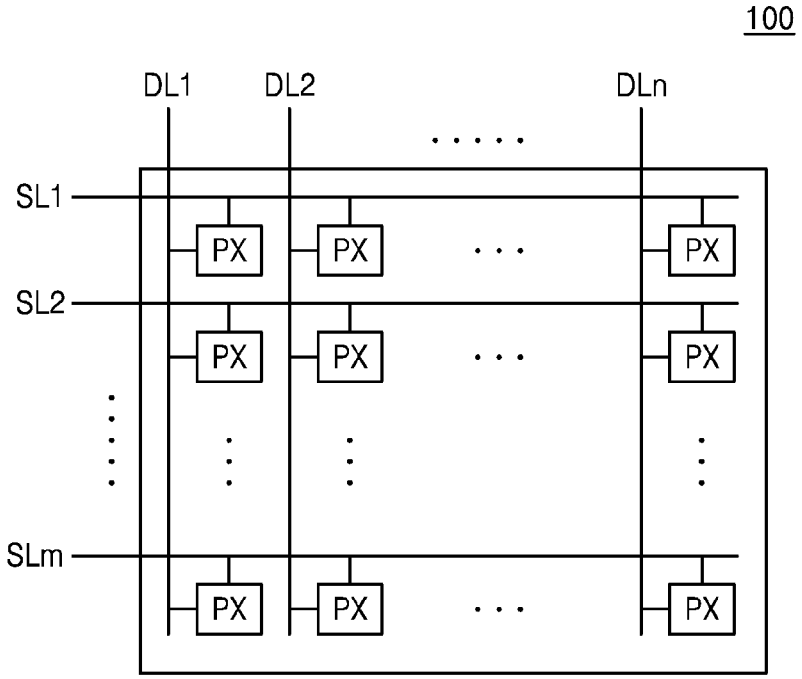
FIG. 1 illustrates a schematic diagram of a display apparatus including a plurality of pixels according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms, and should not be construed as being limited to the descriptions set forth herein. Accordingly, the exemplary embodiments are merely described below, by referring to the figures, to explain aspects of the present description.

Hereinafter, embodiments of the inventive concept will be described in detail with reference to the accompanying drawings. In addition, in the present specification and drawings, like reference numerals refer to like elements throughout, and thus, redundant descriptions are omitted.

It will be understood that when an element, such as a layer, a region, or a substrate, is referred to as being "on," "connected to," or "coupled to" another element, it may be directly on, connected to, or coupled to the other element or intervening elements may be present. In contrast, when an element is referred to as being "directly on," "directly connected to" or "directly coupled to" another element or layer, there are no intervening elements or layers present. Other words used to describe the relationship between elements or layers should be interpreted in a like fashion (e.g., "between," versus "directly between," "adjacent," versus "directly adjacent," etc.).

It will be understood that although the terms "first," "second," etc. may be used herein to describe various components, these components should not be limited by these terms. These components are only used to distinguish one component from another. As used herein, the singular forms "a," "an," and "the" are intended to include the plural forms as well, unless the context clearly indicates otherwise. It will be further understood that the terms "comprises" and/or "comprising" used herein specify the presence of stated features or components, but do not preclude the presence or addition of one or more other features or components.

FIG. 1 illustrates a schematic diagram of a display apparatus 100 including a plurality of pixels PX according to an exemplary embodiment.

Referring to FIG. 1, the display apparatus 100 may further include a plurality of data lines DL1 through DLn extending in a first direction, and a plurality of scan lines SL1 through SLm extending in a second direction. The display apparatus 100 may include the plurality of pixels PX that are located at points where the plurality of data lines DL1 through DLn and the plurality of scan lines SL1 through SLm cross each other.

The data lines DL1 through DLn may supply a data signal to respective ones of the pixels PX. The scan lines SL1 through SLm may supply a scan signal to respective ones of the pixels PX. The pixels PX may emit light having a brightness corresponding to a value of a received data signal. Lighting timing may be controlled via the scan signal.

The display apparatus 100 may be implemented in various forms. For example, an organic light emitting apparatus may include the pixels PX each including an organic emissive device that emits light in response to a driving current corresponding to the value of the data signal. The organic light emitting apparatus may emit, for example, red, green, or blue light. If the display apparatus 100 is a liquid crystal display apparatus, the display apparatus 100 may include a backlight that emits white light, and the pixels PX may emit lights of various colors through a color filter.

Figure 2:
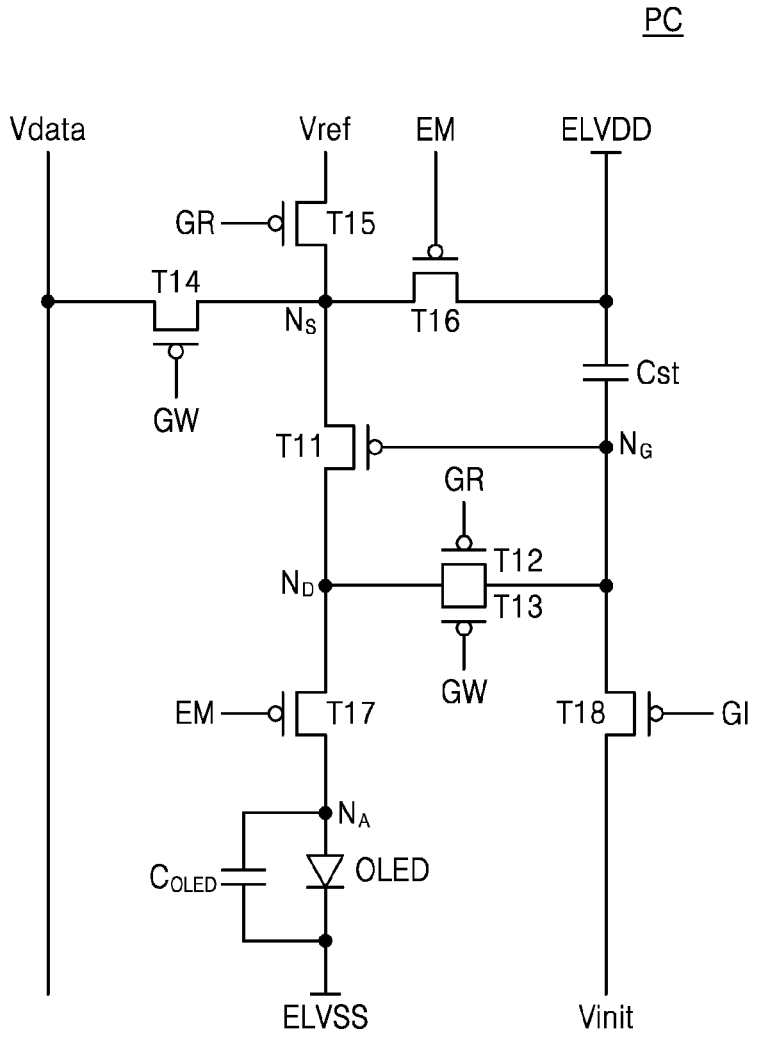
FIG. 2 illustrates a circuit diagram of a pixel circuit according to an exemplary embodiment.

FIG. 2 is a circuit diagram of a pixel circuit PC according to an exemplary embodiment.

Referring to FIG. 2, the pixel circuit PC according to an exemplary embodiment may include 8 transistors T11 through T18, a storage capacitor Cst, and an organic light emitting diode OLED. The organic light emitting diode OLED may include an internal electricity capacitance $C_{OLED}$.

The first transistor T11 may output a driving current corresponding to a value of a data voltage $V_{data}$ to an output node $N_D$. The second transistor T12 may receive a reference voltage through the first transistor T11 during a first time section, may diode-connect the first transistor T11, and may compensate for a threshold voltage of the first transistor T11. The third transistor T13 may diode-connect the first transistor T11 for a second time section, may receive the data voltage $V_{data}$ having the compensated threshold voltage of the first transistor T11 through the first transistor T11, and may transfer the data voltage $V_{data}$ to the storage capacitor Cst.

Meanwhile, a first electrode of the second transistor T12 and a first electrode of the third transistor T13 may be connected to a drain terminal of the first transistor T11, and a second electrode of the second transistor T12 and a second electrode of the third transistor T13 may be connected to a gate terminal of the first transistor T11.

The second transistor T12 (as well as the fifth transistor T15, which will be discussed further below) may be turned on by applying a first control signal GR to a gate electrode of the second transistor T12 (as well as to a gate electrode of the fifth transistor T15) during the first time section. In this regard, a reference voltage $V_{ref}$ may be applied to a source electrode of the first transistor T11, and the first transistor T11 may be diode-connected to apply the reference voltage $V_{ref}$ to the gate terminal of the first transistor T11. The reference voltage $V_{ref}$ applied to the gate terminal of the first transistor T11 may compensate for the threshold voltage of the first transistor T11.

The third transistor T13 (as well as the fourth transistor T14, which will be discussed further below) may be turned on by applying a second control signal GW to a gate electrode of the third transistor T13 (as well as to a gate electrode of the fourth transistor T14) during the second time section. In this regard, a data voltage $V_{data}$ may be applied to the source electrode of the first transistor T11, and the first transistor T11 may be diode-connected to apply the data voltage $V_{data}$ to the gate terminal (i.e., a gate node $N_G$) of the first transistor T11. The data voltage $V_{data}$ applied to the gate terminal of the first transistor T11 may be stored in the storage capacitor Cst.

In this regard, the first time section and the second time section may be temporally discriminated and might not overlap each other. In more detail, while the pixel circuit PC emits light once, the first time section may precede the second time section. Thus, a time when the second transistor T12 is turned on may precede a time when the third transistor T13 is turned on, and the data voltage $V_{data}$ may be transferred after the threshold voltage of the first transistor T11 is compensated.

A first electrode of the storage capacitor Cst may be connected to a power voltage line (e.g., ELVDD), and a second electrode of the storage capacitor Cst may be connected to a gate electrode of the first transistor T11. The storage capacitor Cst may perform a function of storing the data voltage $V_{data}$ transferred by the third transistor T13.

The organic light emitting diode OLED may receive the driving current output from the first transistor T11 through the output node $N_D$, and may emit light of brightness corresponding to a value of the received driving current. Meanwhile, a cathode of the organic light emitting diode OLED may be connected to a ground (e.g., ELVSS), and the driving current may flow from an anode of the organic light emitting diode OLED to the cathode thereof. The cathode of the organic light emitting diode OLED may be connected to a voltage line that supplies a power voltage ELVSS that may have a zero electric potential as the ground.

Meanwhile, the pixel circuit PC may further include the fourth transistor T14 and the fifth transistor T15. The fourth transistor T14 may receive the data voltage $V_{data}$ from a data line that supplies the data voltage $V_{data}$, and may transfer the data voltage $V_{data}$ to the third transistor T13. In this regard, the third transistor T13 may diode-connect the first transistor T11, may receive the data voltage $V_{data}$ applied to the source electrode of the first transistor T11, and may transfer the received data voltage $V_{data}$ to the storage capacitor Cst. The data voltage $V_{data}$ transferred to the storage capacitor Cst may be a voltage for compensating for the threshold voltage $V_{th}$ of the first transistor T11 and may have a value of $V_{data}+V_{th}$.

Meanwhile, a first electrode of the fourth transistor T14 may be connected to a data line, and a second electrode of the fourth transistor T14 may be connected to the source electrode of the first transistor T11, and thus the data voltage $V_{data}$ supplied from the data line may be transferred to the third transistor T13 by diode-connecting the first transistor T11.

The fifth transistor T15 may receive the reference voltage $V_{ref}$ from a line supplying the reference voltage $V_{ref}$, and may transfer the reference voltage $V_{ref}$ to the second transistor T12. In this regard, the second transistor T12 may diode-connect the first transistor T11, and may receive the reference voltage $V_{ref}$ applied to the source electrode of the first transistor T11. The reference voltage $V_{ref}$ transferred to the second transistor T12 by diode-connecting the first transistor T11 may be applied to the gate electrode of the first transistor T11, and may compensate for the threshold voltage $V_{th}$ of the first transistor T11.

The pixel circuit PC may further include the sixth transistor T16 and the seventh transistor T17. The sixth transistor T16 and the seventh transistor T17 may be turned on by a light emitting control signal EM during a light emitting section (e.g., a light emitting section of time) in which the organic light emitting diode OLED emits light.

A first electrode of the sixth transistor T16 may be connected to a power voltage line (e.g., ELVDD), and a second electrode thereof may be connected to the source electrode of the first transistor T11, and the sixth transistor T16 may be turned on by the light emitting control signal EM during the light emitting section to transfer a power voltage ELVDD supplied from the power voltage line to the source electrode of the first transistor T11.

The light emitting section may be a section of time after the reference voltage $V_{ref}$ is applied to the gate electrode of the first transistor T11 by the second transistor T12 and the fifth transistor T15 during the first time section, and after the data voltage $V_{data}+V_{th}$, resulting from compensating for the threshold voltage $V_{th}$ of the first transistor T11 is stored in the storage capacitor Cst by the third transistor T13 and the fourth transistor T14 during the second time section.

Therefore, a voltage applied to the gate electrode of the first transistor T11 may be $V_{ref}+V_{data}+V_{th}$ during the light emitting section. During the light emitting section, the power voltage ELVDD may be applied to the source electrode of the first transistor T11, and thus a Vgs of the first transistor T11, which is a difference between the gate voltage and the source voltage of the first transistor T11, may be $V_{ref}+V_{data}+V_{th}-ELVDD$.

The first transistor T11 may output a driving current corresponding to the voltage $V_{ref}+V_{data}+V_{th}-ELVDD$ to the output node $N_D$ during the light emitting section.

A first electrode of the seventh transistor T17 may be connected to the output node $N_D$, and a second electrode thereof may be connected to an anode of the organic light emitting diode OLED. The seventh transistor T17 may be turned on by the light emitting control signal EM to transfer the driving current output from the first transistor T11 to the anode of the organic light emitting diode OLED.

Therefore, the organic light emitting diode OLED may receive the driving current during the light emitting section, and may emit light of brightness corresponding to a value of the driving current.

The pixel circuit PC may further include the eighth transistor T18. A first electrode of the eighth transistor T18 may be connected to the gate electrode of the first transistor T11, and a second electrode of the eighth transistor T18 may be connected to an initialization voltage line (e.g., $V_{init}$). The initialization voltage line may supply an initialization voltage $V_{init}$. The eighth transistor T18 may be turned on by a third control signal GI during an initialization section (e.g., initialization section of time) to transfer the initialization voltage $V_{init}$ to the gate electrode of the first transistor T11. In this regard, the initialization voltage $V_{init}$ may be a voltage corresponding to white on a gray level, and may set to be a voltage level for initializing a pixel.

Meanwhile, the value of the reference voltage $V_{ref}$ may be greater than that of the initialization voltage $V_{init}$ and may be smaller than that of the data voltage $V_{data}$. An operation of the pixel circuit PC may temporally include the initialization section, the first time section, the second time section, and the light emitting section. During the initialization section, the initialization voltage $V_{init}$ may be applied to the gate electrode of the first transistor T11 that is able to output the driving current. During the first time section, the reference voltage $V_{ref}$ may be applied to the gate electrode of the first transistor T11, and may compensate for the threshold voltage $V_{th}$ of the first transistor T11. During the second time section, the data voltage $V_{data}+V_{th}$ resulting from compensating for the threshold voltage $V_{th}$ of the first transistor T11 may be stored in the storage capacitor Cst.

The initialization voltage $V_{init}$ may be set to be a smaller level than that of the reference voltage $V_{ref}$, and the initialization section may precede the first time section in which the reference voltage $V_{ref}$ is applied to compensate for the threshold voltage $V_{th}$ of the first transistor T11, and thus a value of a voltage applied to the gate electrode of the first transistor T11 may increase from the initialization section to the first time section.

The reference voltage $V_{ref}$ may be set as a smaller level than that of the data voltage $V_{data}$, and the first time section may precede the second time section in which the data voltage $V_{data}$ is written, and thus the value of the voltage applied to the gate electrode of the first transistor T11 may increase from the first time section to the second time section.

In general, a threshold voltage of a driving transistor may be compensated during a data write section. When a difference between the initialization voltage $V_{init}$ and the data voltage $V_{data}$ is large, because a voltage increases, an amount of time to apply the data voltage $V_{data}$ may be insufficient, and thus the data voltage $V_{data}$ may not be accurately applied.

For example, when a P-channel transistor (PMOS) is used (e.g., the pixel circuit PC of FIG. 2), a data voltage corresponding to a low gray level may be set to have a greater value than that of a data voltage corresponding to a high gray level, and may be greatly different from the initialization voltage. Thus, the data voltage may not be accurately applied at the low gray level, which may cause a Mura phenomenon due to a difference of brightness. Such a problem may be serious in a large size and high resolution display apparatus.

The pixel circuit PC according to an exemplary embodiment may compensate for the threshold voltage of a driving transistor (i.e., the first transistor T11) and may increase a gate voltage of the driving transistor to a predetermined voltage level by providing the first time section corresponding to a threshold voltage compensation section between the first initialization section and the second time section corresponding to the data write section, and by applying the reference voltage $V_{ref}$ of a level that is greater than that of the initialization voltage $V_{init}$ and that is smaller than that of the data voltage $V_{data}$. Thus, a size of the data voltage $V_{data}$ that is to be applied and a size of a gate voltage of the driving transistor may be reduced in the data write section, thereby providing an effect of emitting light of accurate brightness in the organic light emitting diode OLED when the data write section is a relatively short amount of time.

Figure 3:
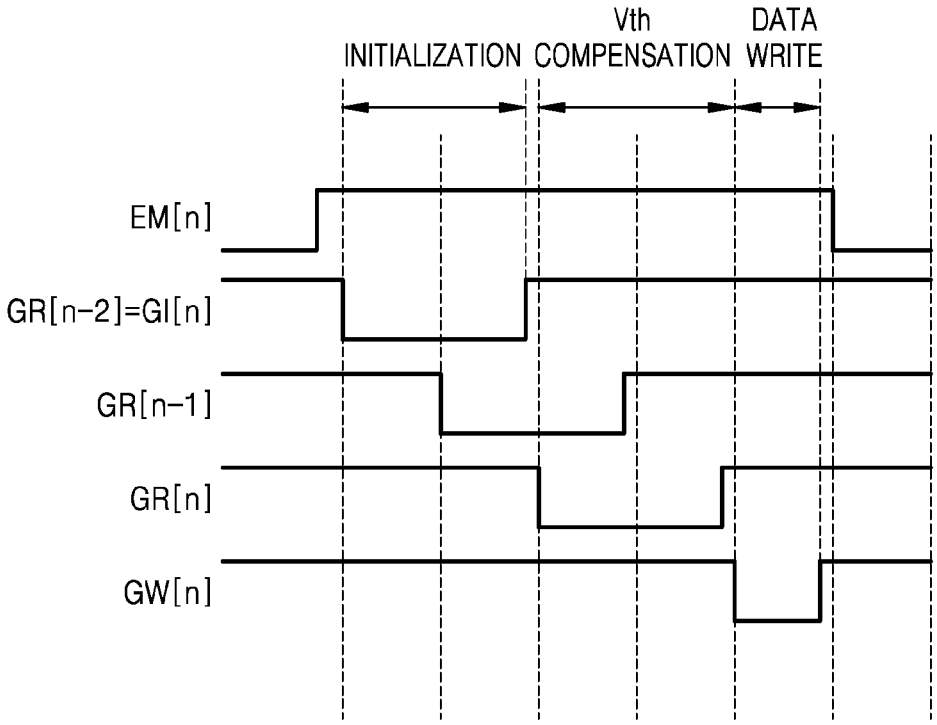
FIG. 3 illustrates a timing diagram for describing an operation of a pixel circuit over time according to an exemplary embodiment.

FIG. 3 is a timing diagram for describing an operation of the pixel circuit PC over time according to an exemplary embodiment.

As described with reference to FIG. 2 above, the pixel circuit PC according to an exemplary embodiment may sequentially include an initialization section, a first time section, a second time section, and a light emitting section. In FIG. 3, a Vth compensation section may correspond to the first time section, and a Data write section may correspond to the second time section. In the timing diagram of FIG. 3, a horizontal axis may indicate time, and a vertical axis may indicate different control signals applied to a pixel disposed an nth row, as an example.

The operation of the pixel circuit PC over time, according to an exemplary embodiment, will be described with reference to FIGS. 2 and 3 below.

During the initialization section, a third control signal GI[n] may be applied to turn on the eighth transistor T18. If the eighth transistor T18 is turned on, the initialization voltage $V_{init}$ may be applied to the gate electrode of the first transistor T11.

In the Vth compensation section, a first control signal GR[n] may be applied to turn on the second transistor T12 and the fifth transistor T15. If the second transistor T12 and the fifth transistor T15 are turned on, the reference voltage $V_{ref}$ may be applied to the gate electrode of the first transistor T11 by diode-connecting the first transistor T11.

In the data write section, a second control signal GW[n] may be applied to turn on the third transistor T13 and the fourth transistor T14. If the third transistor T13 and the fourth transistor T14 are turned on, the data voltage $V_{data}$ may be applied to the gate electrode of the first transistor T11 by diode-connecting the first transistor T11.

In the light emitting section, a voltage of a light emitting control signal EM[n] may be changed to a low level to turn on the sixth transistor T16 and the seventh transistor T17. In this regard, the first transistor T11 may output a driving current corresponding to a difference between a gate voltage and a source voltage to an output node. The driving current may be transferred to the organic light emitting diode OLED through the seventh transistor T17. The organic light emitting diode OLED may emit light of brightness corresponding to the driving current.

In this regard, if time corresponding to the Data write section is defined as 1H (e.g., one unit of time), the initialization section and the Vth compensation section may have about 2H (e.g., two units of time). The third control signal GI[n] applied to a current pixel and a first control signal GR[n−2] applied to a pixel disposed at a row that is two rows before the row of the current pixel may be synchronized. That is, the Vth compensation section of a pixel disposed at a row that is two rows before a current row may be temporally identical with the initialization section of the current row.

If the control signals applied to the pixel circuit PC are applied as shown in the timing diagram of FIG. 3, because a sufficient Vth compensation time (2H) may be secured, a data signal of an accurate voltage level may be written when the data signal having a high voltage corresponding to a low gray level is written, and thus the organic light emitting diode OLED may emit light of accurate brightness at the low gray level, thereby avoiding/reducing a Mura that may otherwise occur due to a brightness difference.

Figure 4:
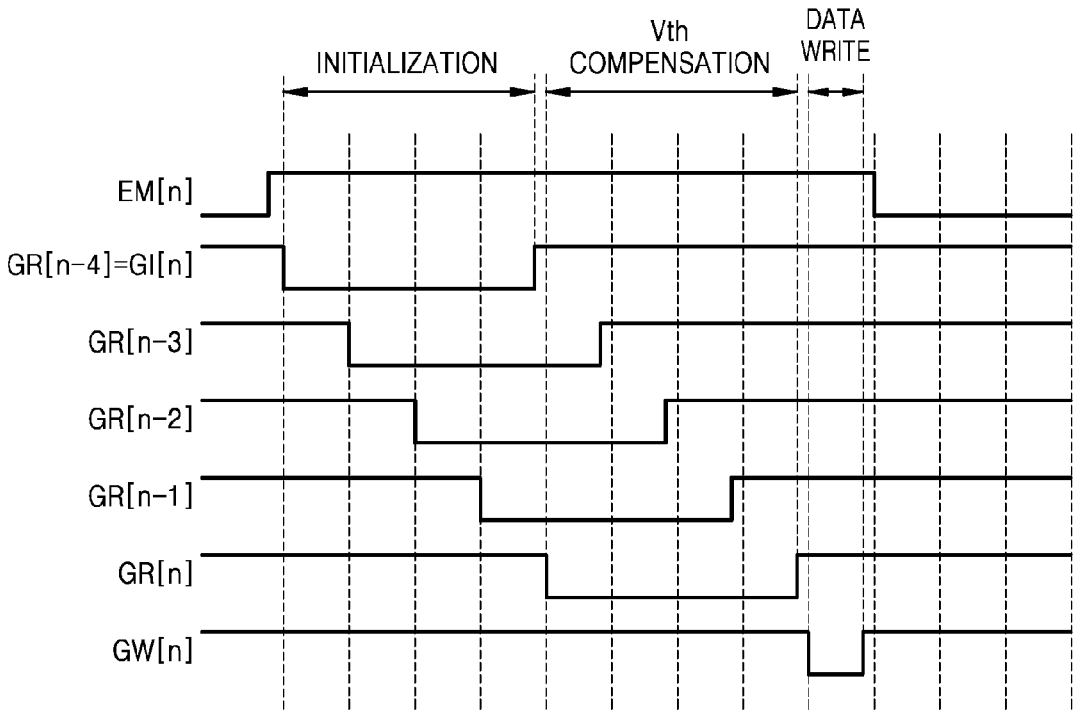
FIG. 4 illustrates a timing diagram for describing an operation of a pixel circuit over time according to another exemplary embodiment.

FIG. 4 is a timing diagram for describing an operation of the pixel circuit PC over time according to another exemplary embodiment.

Like the timing diagram of FIG. 3, the timing diagram of FIG. 4 may indicate control signals applied to the pixel circuit PC described with reference to FIG. 2 above. The pixel circuit PC may sequentially include an initialization section, a Vth compensation section, a Data write section, and a light emitting section.

Unlike the timing diagram of FIG. 3, the third control signal Gi[n] that is applied to a current pixel may be synchronized with a first control signal GR[n−4] that is applied to a pixel disposed at a row that is four rows before the row of the current pixel in the timing diagram of FIG. 4. The first control signal GR applied to pixels located at adjacent rows may be separated by a time difference of 1H.

Therefore, the Vth compensation section may secure time represented as 4H in the timing diagram of FIG. 4, and thus a sufficient time for increasing a gate voltage of the first transistor T11 from the initialization voltage $V_{init}$ to the reference voltage $V_{ref}$ may be provided.

Figure 5:
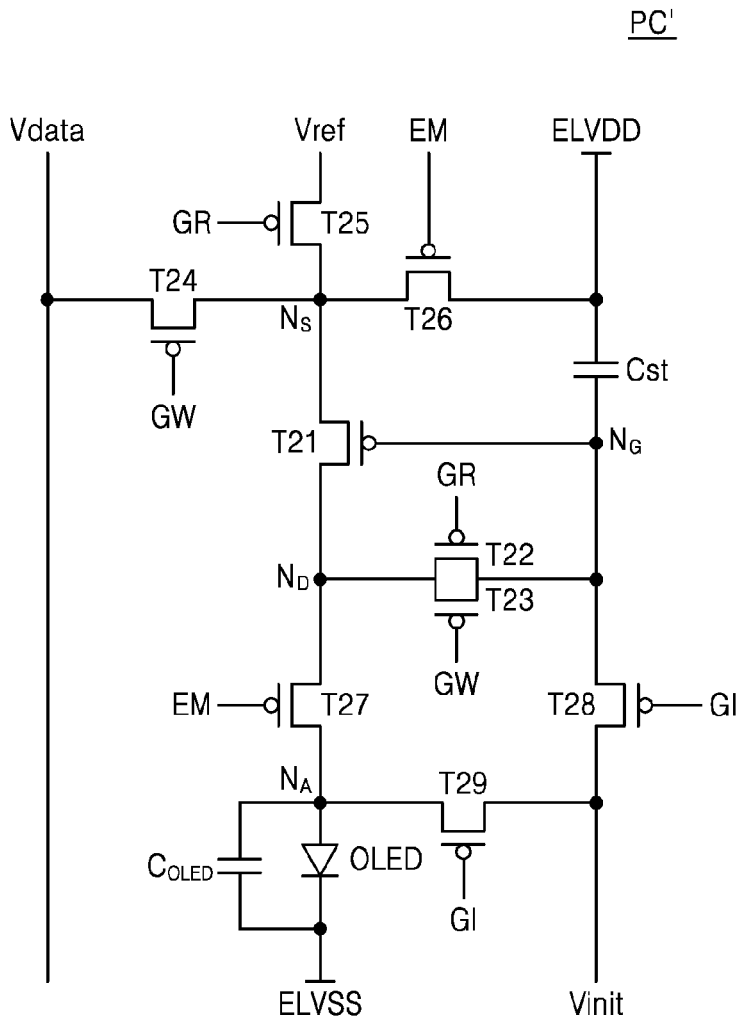
FIG. 5 illustrates a circuit diagram of a pixel circuit according to another exemplary embodiment.

FIG. 5 is a circuit diagram of a pixel circuit PC' according to another exemplary embodiment.

The pixel circuit PC' of FIG. 5 may further include a ninth transistor T29 in addition to transistors T11-T18 of the pixel circuit PC described with reference to FIG. 2 above. That is, the pixel circuit PC' of FIG. 5 may include first through eighth transistors T21 through T28, the storage capacitor Cst, and the organic light emitting diode OLED, like the pixel circuit PC of FIG. 2, which perform substantially the same functions, and thus detailed descriptions thereof are omitted.

A first electrode of the ninth transistor T29 may be connected to an initialization voltage line, and a second electrode thereof is connected to an anode of the organic light emitting diode OLED. The third control signal GI may be applied to a gate electrode of the ninth transistor T29, and the ninth transistor T29 may be turned on during an initialization section (like the eighth transistor T28). If the ninth transistor T29 is turned on, the initialization voltage $V_{init}$ may be applied to the anode of the organic light emitting diode OLED.

During a non-light emitting section (i.e., an operation section excluding the light emitting section), no driving current is output from a driving transistor (i.e., from the first transistor T21), and thus the organic light emitting diode OLED may not normally emit light. However, a problem may occur, in that the organic light emitting diode OLED may slightly emit light due to a leakage current of the driving transistor.

As described with reference to FIG. 2 above, a cathode of the organic light emitting diode OLED may be grounded. In this regard, if a value of the initialization voltage $V_{init}$ is set to be negative (−), and the initialization voltage $V_{init}$ is applied to the anode of the organic light emitting diode OLED, the problem may be avoided as the organic light emitting diode OLED emits light when the leakage current is transferred to the anode.

Therefore, the initialization voltage $V_{init}$ may have a value less than that of the power voltage ELVSS supplied to the cathode of the organic light emitting diode OLED.

Meanwhile, the pixel circuit PC' of FIG. 5 may operate according to timing diagrams of FIGS. 3 and 4.

Figure 6:
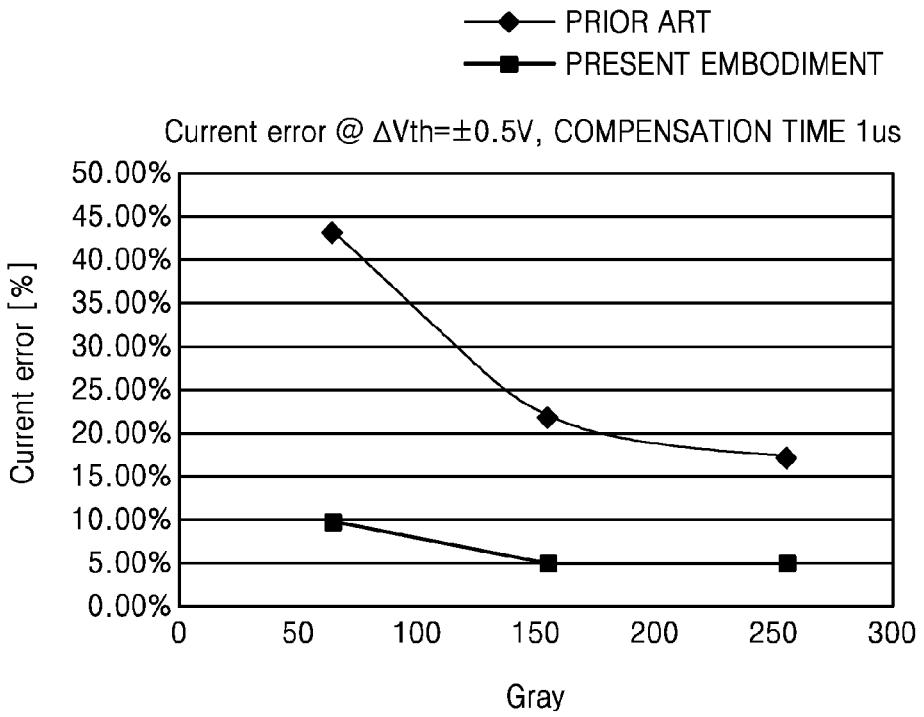
FIG. 6 illustrates a graph illustrating a threshold voltage compensation effect of a pixel circuit according to an exemplary embodiment.

FIG. 6 illustrates a graph of a threshold voltage compensation effect of a pixel circuit according to an exemplary embodiment.

In the graph of FIG. 6, a horizontal axis may indicate gray values and a vertical axis may indicate driving current error rates. The driving current error rate of 0% may mean that a current having a theoretically calculated value is correctly output from a driving transistor.

Numerical values of the graph of FIG. 6 indicate the driving current error rates when the threshold voltage Vth of the driving transistor is set to have an error at ±0.5V, and when a compensation time is set to be 1 μs in a pixel circuit using a driving transistor having a threshold voltage Vth of about −2V. The compensation time may correspond to a data write section. In an existing pixel circuit, a threshold voltage compensation is performed during the data write section. The time period of 1 μs may correspond to 1H described with reference to FIGS. 3 and 4 above. The pixel circuit according to an exemplary embodiment may have a threshold voltage compensation section of 2H before the data write section.

As a result of measuring the driving current error rates for each gray level obtained by using the pixel circuit according to an exemplary embodiment, and also driving current error rates obtained by using a conventional/existing pixel circuit, as shown in FIG. 6, the pixel circuit according to an exemplary embodiment has an improved driving current error rate when compared to the existing pixel circuit over all gray levels.

Such an effect is more pronounced at a low gray level because, as described with reference to FIG. 2 above, when a data voltage corresponding to a low gray level is set to have a greater value than a data voltage corresponding to a high gray level in a pixel circuit that uses a P-channel transistor (PMOS), it may not be easy to increase a gate voltage of the driving transistor from an initialization voltage to a data voltage, due to the fact that a sufficient threshold voltage compensation time might not be secured.

The pixel circuit according to an exemplary embodiment may apply a reference voltage having a value greater than the initialization voltage and less than the data voltage during a threshold voltage compensation section preceding the data write section when the data voltage is applied. Thus, an effect of reducing an increased gap from the gate voltage of the driving transistor to the data voltage during the data write section may be obtained, thereby being possible to apply the data voltage having a precise value.

Therefore, according to the pixel circuit of an exemplary embodiment, an improved driving current error rate may be obtained compared to the existing pixel circuit of FIG. 6.

Meanwhile, the pixel circuits PC and PC' described with reference to FIGS. 2 through 5 may be included in the pixels PX included in the display apparatus 100 described with reference to FIG. 1 above.

That is, a display apparatus according to an exemplary embodiment may include, like the display apparatus 100 described with reference to FIG. 1 above, the plurality of data lines DL1 through DLn extending in a first direction and configured to supply a data signal, the plurality of scan lines SL1 through SLm extending in a second direction and configured to supply a scan signal, and the plurality of pixels PX that are disposed in points where the plurality of data lines DL1 through DLn and the plurality of scan lines SL1 through SLm cross each other.

Each of the pixels PX may sequentially include an initialization section, a threshold voltage compensation section, a data write section, and a light emitting section. Each of the pixels PX may include the pixel circuit PC of FIG. 2 or the pixel circuit PC' of FIG. 5. The pixel circuit PC or PC' may operate according to a timing diagram of FIG. 3 or 4.

The display apparatus according to an exemplary embodiment may further include a first control line, a second control line, a third control line, and a light emitting control line that respectively supply the first control signal GR, the second control signal GW, the third control signal GI, and the light emitting control signal EM necessary for driving the pixel circuit PC or PC' according to an exemplary embodiment.

The detailed configuration and operation of the pixel circuit PC or PC' are the same as described with reference to FIGS. 2 through 6 above. The display apparatus according to an exemplary embodiment corresponds to a combination of the display apparatus 100 described with reference to FIG. 1 above and the pixel circuit PC or PC' according to an exemplary embodiment described with reference to FIGS. 2 through 6 above.

As described above, according to the one or more of the above exemplary embodiments, there are provided a pixel circuit and a display apparatus including the pixel circuit, whereby a Mura phenomenon due to a brightness difference in a low gray level may be reduced or prevented.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. A pixel circuit comprising:

a first transistor configured to output a driving current corresponding to a data voltage to an output node;

an organic light emitting diode connected to the output node and configured to emit light according to the driving current output from the first transistor;

a storage capacitor coupled to the first transistor and configured to store the data voltage;

a second transistor configured to receive a reference voltage from the first transistor during a first time section, configured to diode-connect the first transistor, and configured to compensate for a threshold voltage of the first transistor;

a third transistor configured to diode-connect the first transistor during a second time section, configured to receive the data voltage through the first transistor for which the threshold voltage of the first transistor is compensated, and configured to transfer the data voltage to the storage capacitor;

a fourth transistor having a first electrode directly coupled to a data line that is configured to supply the data voltage, and a second electrode coupled to a source electrode of the first transistor, the fourth transistor being configured to be turned on during the second time section, and further being configured to transfer the data voltage to the third transistor; and a fifth transistor having a first electrode coupled to a reference voltage line configured to supply the reference voltage, and a second electrode coupled to both the second electrode of the fourth transistor and the source electrode of the first transistor, the fifth transistor being configured to be turned on during the first time section, and further being configured to transfer the reference voltage to the second transistor.

2. The pixel circuit of claim 1, wherein a first electrode of the storage capacitor is coupled to a power voltage line, and wherein a second electrode of the storage capacitor is coupled to a gate electrode of the first transistor.

3. The pixel circuit of claim 1, wherein a first electrode of the second transistor and a first electrode of the third transistor are coupled to a drain electrode of the first transistor, and wherein a second electrode of the second transistor and a second electrode of the third transistor are coupled to a gate electrode of the first transistor.

4. The pixel circuit of claim 1, further comprising:

a sixth transistor having a first electrode coupled to a power voltage line, and a second electrode coupled to the source electrode of the first transistor; and a seventh transistor having a first electrode coupled to the output node, and a second electrode coupled to an anode of the organic light emitting diode, wherein the sixth transistor and the seventh transistor are configured to turn on during a light emitting section.

5. The pixel circuit of claim 1, further comprising an eighth transistor having a first electrode coupled to a gate electrode of the first transistor, and a second electrode coupled to an initialization voltage line, wherein the eighth transistor is configured to turn on during an initialization section, and is configured to apply an initialization voltage to the first transistor.

6. The pixel circuit of claim 5, wherein a level of the reference voltage is greater than a level of the initialization voltage, and is less than a level of the data voltage.

7. The pixel circuit of claim 1, further comprising a ninth transistor having a first electrode coupled to an initialization voltage line, and a second electrode coupled to an anode of the organic light emitting diode, wherein the ninth transistor is configured to turn on during an initialization section, and is configured to apply an initialization voltage to the anode of the organic light emitting diode.

8. A display apparatus comprising:

a plurality of data lines extending in a first direction, and configured to supply a data signal;

a plurality of scan lines extending in a second direction, and configured to supply a scan signal; and a plurality of pixels respectively at crossing regions of the plurality of data lines and the plurality of scan lines, the plurality of pixels operating according to an initialization section, a threshold voltage compensation section, a data write section, and a light emitting section arranged in a sequential order;

wherein each of the plurality of pixels comprises:

a first transistor configured to output a driving current corresponding to a level of a data voltage to an output node;

an organic light emitting diode coupled to the output node, and configured to emit light according to the driving current output from the first transistor;

a storage capacitor coupled to the first transistor, and configured to store the data voltage;

a second transistor configured to receive a reference voltage from the first transistor during the threshold voltage compensation section, configured to diode-connect the first transistor, and further configured to compensate for a threshold voltage of the first transistor;

a third transistor configured to diode-connect the first transistor during the data write section, configured to receive the data voltage through the first transistor for which the threshold voltage of the first transistor is compensated, and further configured to transfer the data voltage to the storage capacitor;

a fourth transistor having a first electrode directly coupled to a data line that is configured to supply the data voltage, and a second electrode coupled to a source electrode of the first transistor, the fourth transistor being configured to be turned on during the data write section, and further being configured to transfer the data voltage to the third transistor; and a fifth transistor having a first electrode coupled to a reference voltage line configured to supply the reference voltage, and a second electrode coupled to both the second electrode of the fourth transistor and the source electrode of the first transistor, the fifth transistor being configured to be turned on during the threshold voltage compensation section, and further being configured to transfer the reference voltage to the second transistor.

9. The display apparatus of claim 8, wherein a first electrode of the storage capacitor is coupled to a power voltage line, and wherein a second electrode of the storage capacitor is coupled to a gate electrode of the first transistor.

10. The display apparatus of claim 9, further comprising a ninth transistor having a first electrode coupled to an initialization voltage line, and a second electrode coupled to an anode of the organic light emitting diode, wherein the ninth transistor is configured to turn on during the initialization section, and is configured to apply an initialization voltage to the anode of the organic light emitting diode.

11. The display apparatus of claim 8, wherein a first electrode of the second transistor and a first electrode of the third transistor are coupled to a drain electrode of the first transistor, and wherein a second electrode of the second transistor and a second electrode of the third transistor are coupled to a gate electrode of the first transistor.

12. The display apparatus of claim 8, further comprising:

a sixth transistor having a first electrode coupled to a power voltage line, and a second electrode coupled to the source electrode of the first transistor; and a seventh transistor having a first electrode coupled to the output node, and a second electrode coupled to an anode of the organic light emitting diode, wherein the sixth transistor and the seventh transistor are configured to turn on during a light emitting section.

13. The display apparatus of claim 8, further comprising an eighth transistor having a first electrode coupled to a gate electrode of the first transistor, and a second electrode coupled to an initialization voltage line, wherein the eighth transistor is configured to turn on during the initialization section, and is configured to apply an initialization voltage to the first transistor.

14. The display apparatus of claim 8, wherein a level of the reference voltage is greater than a level of an initialization voltage, and is less than the level of the data voltage.

* * * * *